US009332807B2

(12) United States Patent
Coulter et al.

(10) Patent No.: US 9,332,807 B2
(45) Date of Patent: May 10, 2016

(54) BOOT HANDLE STORM COVER

(71) Applicants: Stuart Coulter, Hanover, NH (US); Greg Pang, Lebanon, NH (US)

(72) Inventors: Stuart Coulter, Hanover, NH (US); Greg Pang, Lebanon, NH (US)

(73) Assignee: Perfect Storm Boot Corporation NH (US)

( * ) Notice: Subject to any disclaimer, the term of this patent is extended or adjusted under 35 U.S.C. 154(b) by 472 days.

(21) Appl. No.: 13/913,590

(22) Filed: Jun. 10, 2013

(65) Prior Publication Data

US 2014/0360051 A1 Dec. 11, 2014

(51) Int. Cl.

| | |
|---|---|
| ***A43B 11/00*** | (2006.01) |
| ***A43B 23/02*** | (2006.01) |
| ***A43B 3/02*** | (2006.01) |

(52) U.S. Cl.

CPC ..... *A43B 23/025* (2013.01); *A43B 3/02* (2013.01); *A43B 11/00* (2013.01); *A43B 23/0295* (2013.01)

(58) Field of Classification Search

CPC ..... A43B 2/02; A43B 11/00; A43B 23/022; A43B 23/0295; A43B 7/085

USPC ..... 36/138, 56, 89

See application file for complete search history.

(56) References Cited

U.S. PATENT DOCUMENTS

| | | | | | |
|---|---|---|---|---|---|
| 387,119 | A * | 7/1888 | Stevens | A43B 7/20 | 36/128 |
| 746,338 | A * | 12/1903 | Keen | A43B 5/0407 | 128/DIG. 20 |
| D111,808 | S * | 10/1938 | Hosker | D2/912 | |
| D174,987 | S * | 6/1955 | Gillis | D2/912 | |
| 4,559,722 | A * | 12/1985 | Norton | A43B 5/06 | 36/105 |
| 4,655,465 | A * | 4/1987 | Schaeffer | A43B 5/1691 | 280/11.12 |
| D343,723 | S * | 2/1994 | Adams | D2/970 | |
| 5,498,033 | A * | 3/1996 | Hoshizaki | A43B 1/0018 | 280/841 |
| 6,993,859 | B2 * | 2/2006 | Martin | A43B 3/0047 | 36/114 |
| D593,311 | S * | 6/2009 | del Biondi | D2/910 | |
| D645,653 | S | 9/2011 | Cook | | |
| 8,372,234 | B2 * | 2/2013 | Loveder | A43B 1/0027 | 12/4.1 |
| 8,505,222 | B2 * | 8/2013 | Koyess | A43B 5/1625 | 36/115 |
| D694,994 | S * | 12/2013 | Santos | D2/910 | |
| 2004/0083625 | A1 * | 5/2004 | Wilder | A43B 9/00 | 36/115 |

FOREIGN PATENT DOCUMENTS

| | | | |
|---|---|---|---|
| CN | 202051030 | U | 11/2011 |
| CN | 202375172 | U | 8/2012 |
| DE | 20315725 | U1 | 12/2003 |

* cited by examiner

*Primary Examiner* — Ted Kavanaugh

(57) ABSTRACT

A boot has an upper, at least one slot extending through the upper, and means for closing the at least one slot to prevent the ingress of unwanted materials. The closing means may comprise a piece of material that overlaps and covers the at least one slot.

12 Claims, 4 Drawing Sheets

BOOT HANDLE STORM COVER

BACKGROUND

The present invention is directed to a boot with handles and storm covers over the handles.

Many boots frequently have handles to help someone pull the boot on. The handles may be slots cut into the uppers of the boot. Each boot may have one handle on each side of the upper. U.S. Design Pat. No. D645,653 to Cook illustrates such a boot.

The slots which form the handles may extend from the outer side of the upper to the inner side of the upper. Since the slots are openings, they allow the ingress of moisture, snow, wet leaves, etc.

There is a need for a mechanism for covering the handles so that unwanted material, such as moisture, snow, wet leaves, etc., are not able to enter the interior of the boot.

SUMMARY

In accordance with the present disclosure, there is provided a boot which broadly has an upper, at least one slot extending through the upper, and means for closing the at least one slot to prevent the ingress of unwanted materials. The closing means may comprise at least one piece of material which covers the at least one slot. The at least one piece of material may be non-porous and flexible.

Other details of the boot handle storm cover are set forth in the following detailed description and the accompanying drawings wherein like reference numerals depict like elements.

DETAILED DESCRIPTION

Figure 1:
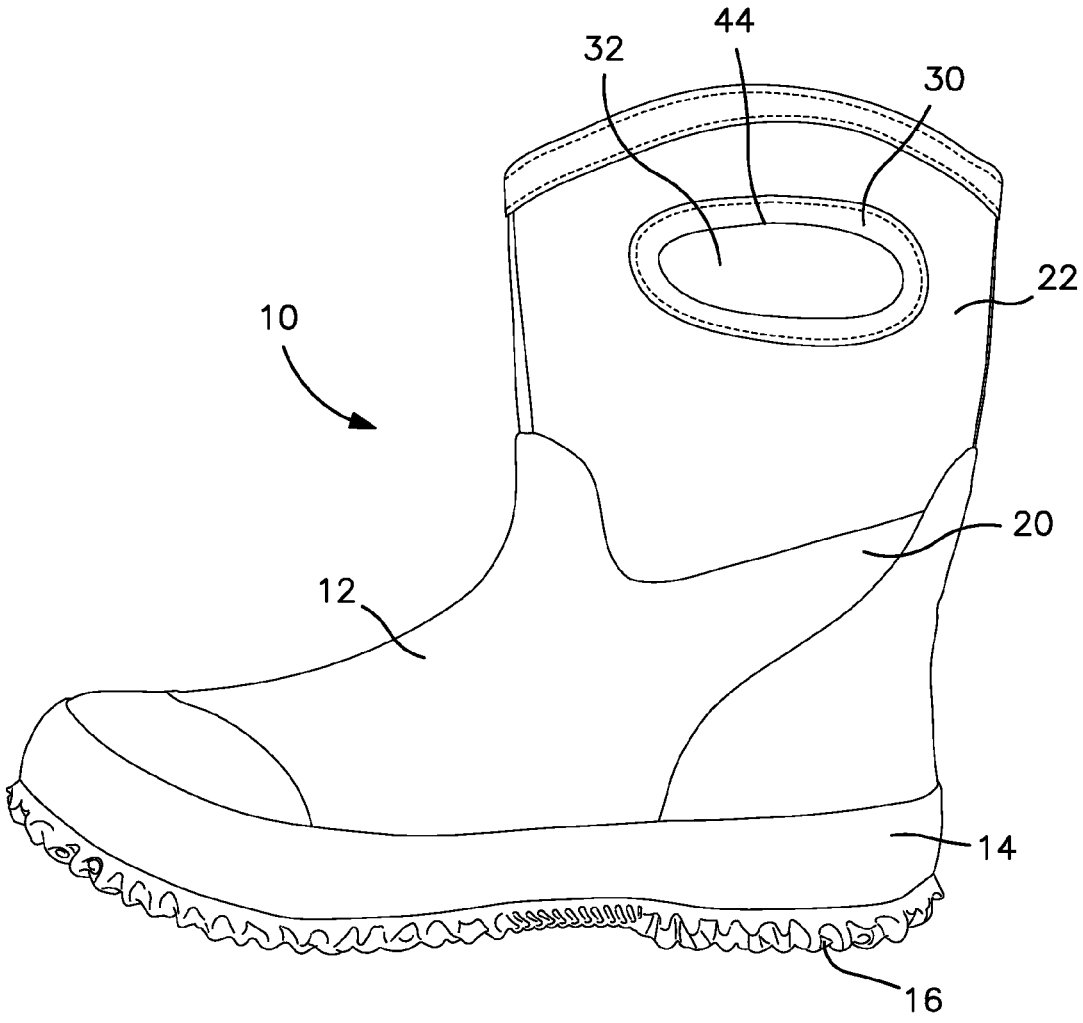
FIG. 1 is a side view of a boot.

Referring now to the drawings, FIGS. 1-4 illustrate a boot 10 having an upper 12 and a lower 14 which includes a sole 16. The upper 12 may be formed from any suitable material. For example, it can be formed from leather, a rubber or plastic material, a woven or non-woven material, a knitted material, and combinations thereof. As an example, the upper 12 may have a plastic portion 20 and an upper fabric portion 22 joined to the portion 20 as shown in FIG. 1.

The lower 14 may also be formed from any suitable material including but not limited to leather, rubber, a plastic material, and combinations thereof. The upper 12 and the lower 14 may be joined together in any desirable manner. For example, they could be bonded together or they could be sewn together.

The sole 16 may be formed from leather, rubber, EVA, fabric, a plastic material, thermal plastic rubber, fabric, and combinations thereof. If desired, the sole may be provided with a tread pattern such as that shown in FIG. 4 and may have a heel 18.

Figure 2:
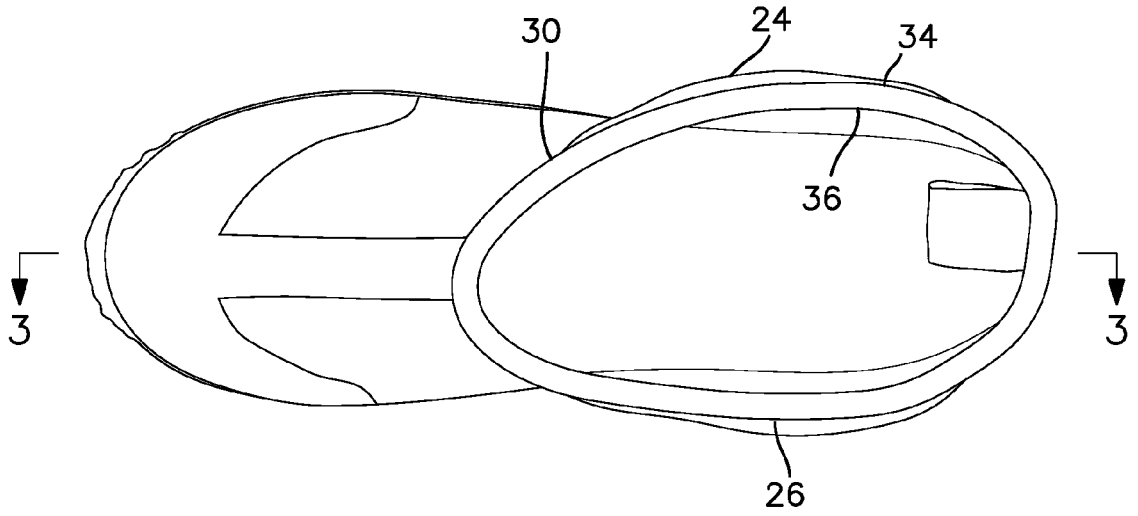
FIG. 2 is a top view of the boot of FIG. 1.

As shown in FIGS. 1 and 2, the boot 12 may have an outer side 24 and an inner side 26. The upper 12 on each of the outer side 24 and the inner side 26 may be provided with a handle 30. Each handle 30 may be a slot 32 which extends from an outer surface 34 of the upper 12 to an inner surface 36 of the upper 12. The slot 32 may have any desired shape. For example, it may be oval shaped. Each slot 32 preferably has a width which allows one or more fingers of a hand to be inserted into the slot.

Figure 3:
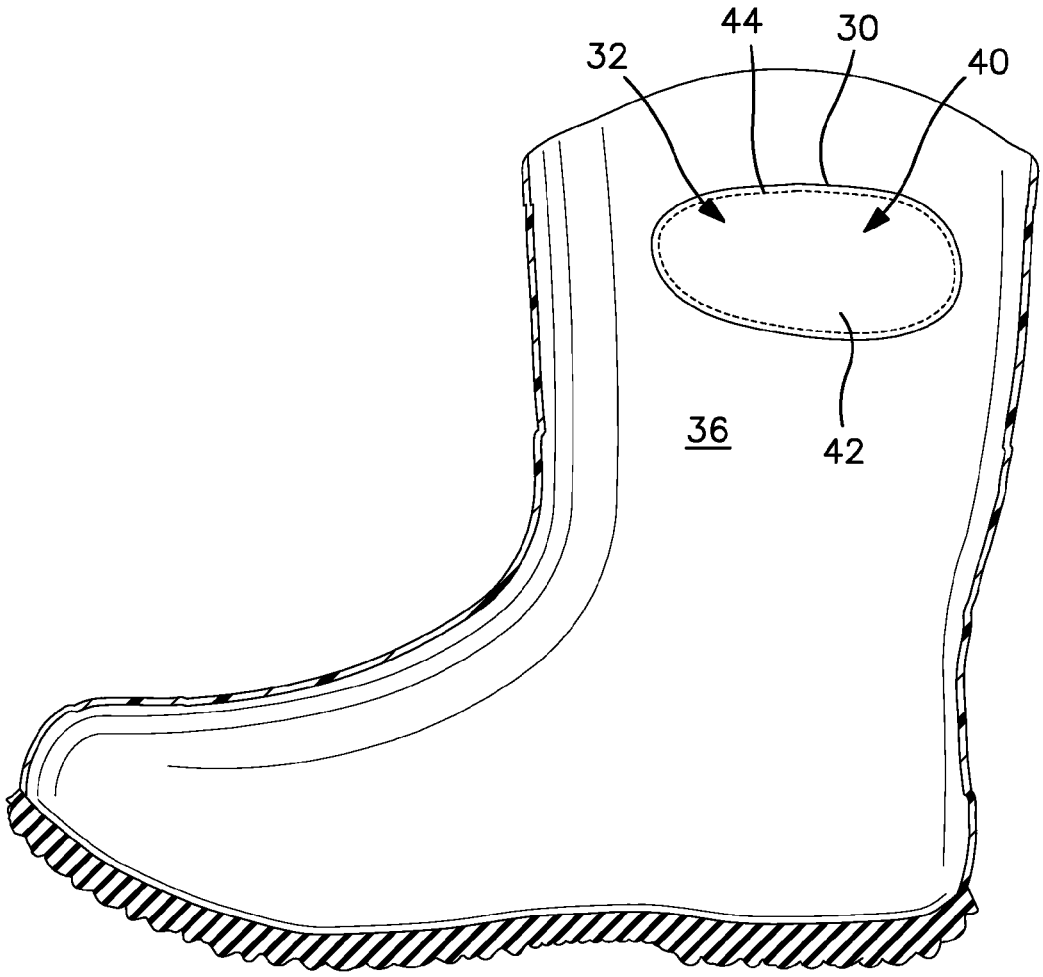
FIG. 3 is a sectional view of the boot of FIG. 2 taken along the lines 3-3 in FIG. 2.
Figure 4:
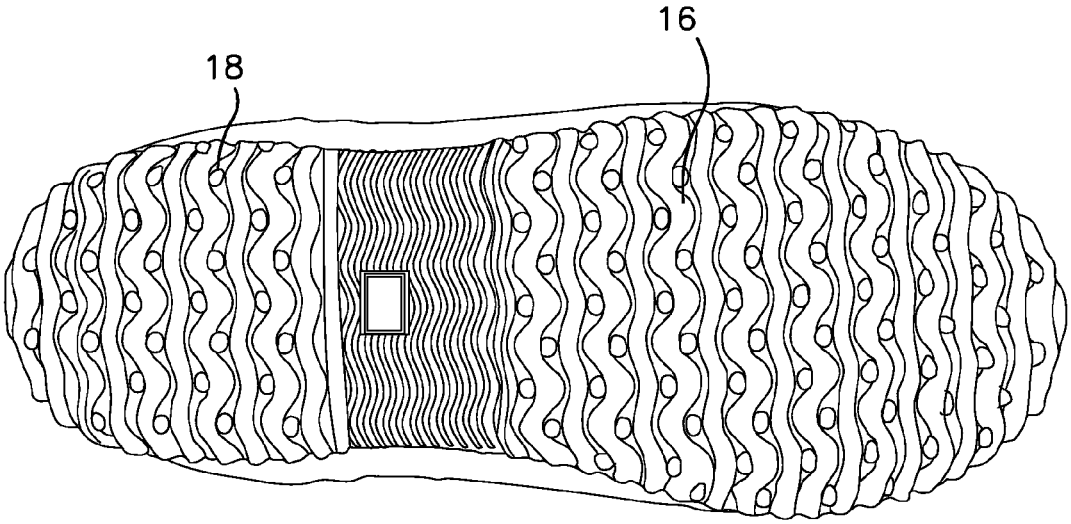
FIG. 4 is a bottom view of the boot of FIG. 1.

Referring now to FIG. 3, in order to prevent the ingress of unwanted materials such as leaves, water, snow, etc. into the boot 10 via the handles 30, a means 40 for closing the slots 32 forming the handles 30 is provided. The closing means 40 may comprise a piece 42 of material which covers the interior surface of and the opening in each slot 32. The piece 42 of material may comprise any suitable material which is impervious to water, snow, leaves, etc. For example, the piece 42 of material may be a solid, non-porous, and flexible material such as neoprene, leather, and the like. The material piece 42 may be sewn to the inner surface 36. Alternatively, the material piece 42 may be bonded to the inner surface 36 by an adhesive.

By using a flexible material 42 for the storm cover, one is able to comfortably slip one's fingers into the slot 32 and grasp the upper surface 44 of the slot and thereby pull the boot on.

While the boot 12 has been illustrated as having handles 30 in the inner and outer sides 24 and 26 of the upper 12, it should be recognized that the boot 12 could also have a handle in the rear of the upper 12. The handle in the rear may be in addition to or in lieu of the handles 30. When present, the handle in the rear would have its slot cover a piece of material to prevent the ingress of unwanted materials.

There has been provided with the present disclosure a boot handle storm cover. While the boot handle storm cover has been described in the context of specific embodiments thereof, other unforeseen alternatives, modifications, and variations may become apparent to those skilled in the art having read the foregoing description. Accordingly, it is intended to embrace those alternatives, modifications, and variations as fall within the broad scope of the appended claims.

What is claimed is:

1. A boot comprising:

an upper having at least one slot extending therethrough and configured to provide a handle for assisting a user to pull on the boot, said slot being defined by a slot edge surface;

a lower having a sole joined to said upper; and at least one piece of material which covers said at least one slot to prevent the ingress of unwanted materials, wherein said piece of material is attached onto an interior surface of said upper along a line of attachment that is spaced apart from said slot edge surface along at least a slot upper edge surface, thereby allowing a user to comfortably insert one or more of their fingers into said slot and grasp said slot upper edge surface to aid in pulling the boot on.

2. The boot of claim 1, wherein said piece of material comprises neoprene.

3. The boot of claim 1, wherein said piece of material is nonporous and flexible.

4. The boot of claim 1, wherein said at least one slot includes a first slot in an outer side of said upper extending therethrough from an outer surface to said inner surface, and a second slot in an inner side of said upper extending therethrough from said outer surface to said inner surface.

5. The boot of claim 1, wherein said upper is formed from a combination of a rubber or a plastic material and a woven or non-woven material.

6. The boot of claim 5, wherein said sole is formed from a material selected from the group consisting of leather, rubber, EVA, thermal plastic rubber, fabric and combinations thereof.

7. The boot of claim 1, wherein said upper is formed from leather.

8. The boot of claim 1 wherein said piece of material is sewn to said interior surface of said upper.

9. The boot of claim 1 wherein said piece of material is bonded to said interior surface of said upper by an adhesive.

10. An improvement for a boot having, an upper having at least one slot extending therethrough and configured to provide a handle for assisting a user to pull on the boot, the slot being defined by a slot edge surface, and a lower having a sole joined to the upper, the improvement comprising:

a piece of material which covers the at least one slot in the upper to prevent the ingress of unwanted materials, wherein said piece of material is attached onto an interior surface of the upper along a line of attachment that is spaced apart from the slot edge surface along at least a slot upper edge surface, thereby allowing a user to comfortably insert one or more of their fingers into the slot and grasp the slot upper edge surface to aid in pulling the boot on.

11. The boot of claim 10 wherein said piece of material is sewn to said interior surface of said upper.

12. The boot of claim 10 wherein said piece of material is bonded to said interior surface of said upper by an adhesive.

* * * * *